US008562232B2

(12) United States Patent
Ishida

(10) Patent No.: US 8,562,232 B2
(45) Date of Patent: Oct. 22, 2013

(54) STICK-SHAPED COSMETIC MATERIAL FEEDING CONTAINER

(75) Inventor: Yukikazu Ishida, Kawaguchi (JP)

(73) Assignee: Tokiwa Corporation, Gifu (JP)

( * ) Notice: Subject to any disclaimer, the term of this patent is extended or adjusted under 35 U.S.C. 154(b) by 368 days.

(21) Appl. No.: 13/021,863

(22) Filed: Feb. 7, 2011

(65) Prior Publication Data

US 2011/0206443 A1 Aug. 25, 2011

(30) Foreign Application Priority Data

Feb. 25, 2010 (JP) ..... 2010-040343

(51) Int. Cl.
*B43K 21/08* (2006.01)

(52) U.S. Cl.
USPC ..... 401/75; 401/68

(58) Field of Classification Search
USPC ..... 401/68, 69, 75, 116
See application file for complete search history.

(56) References Cited

U.S. PATENT DOCUMENTS

| | | | | |
|---|---|---|---|---|
| 3,358,699 | A * | 12/1967 | Bau | 401/70 |
| 6,345,922 | B2 * | 2/2002 | Tani | 401/32 |
| 7,455,467 | B2 * | 11/2008 | Sasaki | 401/88 |
| 7,736,079 | B2 * | 6/2010 | Tani | 401/69 |
| 8,104,984 | B2 * | 1/2012 | Tani | 401/70 |

FOREIGN PATENT DOCUMENTS

JP 2008-178604 A 7/2008

* cited by examiner

*Primary Examiner* — David Walczak
*Assistant Examiner* — Jennifer C Chiang
(74) *Attorney, Agent, or Firm* — Bacon & Thomas, PLLC

(57) ABSTRACT

A stick-shaped cosmetic material feeder container having a female screw member with meshing parts, a container rear part having concave groove parts, a clutch spring member disposed on the rear side of the female screw member having meshing parts, a spring part urging the meshing parts frontward, and convex parts entering into the concave groove parts and being movable in the axial direction and not rotatable with respect to the container rear part, a rear part of the clutch spring member beyond the spring part is not movable in the axial direction with respect to the container rear part, and the spring part contracts to cancel the meshing around the axis between the meshing parts when an excessive rotation torque effects on a movable body.

2 Claims, 8 Drawing Sheets

STICK-SHAPED COSMETIC MATERIAL FEEDING CONTAINER

BACKGROUND OF THE INVENTION

1. Field of the Invention

The present invention relates to a stick-shaped cosmetic material feeding container capable of protruding/retracting a stick-shaped cosmetic material.

2. Description of the Conventional Art

Conventionally, a stick-shaped cosmetic material feeding container described in Japanese Patent Application Laid-Open No. 2008-178604 has been known. The stick-shaped cosmetic material feeding container houses a movable body and a female screw member in a cylindrical container having a container front part and a container rear part. The female screw member integrally includes, from a front side thereof toward a rear side in an axial direction, a female thread to be screwed with a male thread provided on the outer peripheral surface of the movable body, a spring part, and second meshing parts which are urged toward the rear side by the spring part so as to be enabled to mesh around an axis with first meshing parts of the container rear part at a time of relative rotation of the container front part and the container rear part.

Further, in the stick-shaped cosmetic material feeding container, when the container front part and the container rear part are relatively rotated, the movable body is advanced/retreated by a work of a screw part including a male thread of the movable body and a female thread of a female screw member, so that the stick-shaped cosmetic material supported by a top end of the movable body is protruded from and retracted into an opening of the a container top end. At this time, the first meshing parts of the container rear part mesh around the axis with the second meshing parts of the female screw member, and the female screw member is connected to the container rear part non-rotatably around the axis, so that the movable body is caused to be not rotatable around the axis and be movable in the axial direction with respect to the container front part. The female screw member is caused to be rotatable around the axis with respect to the container front part and non-rotatably connected to the container rear part by the aforementioned meshing. On the other hand, when the movable body reaches an advancing limit or a retreating limit and relative rotation force for further movement is given to the movable body, an excessive rotation torque effects on the movable body. In such a condition, the spring part of the female screw member is contracted and the second meshing parts of the female screw member advance against urging force of the spring part of the female screw member, so that the meshing around the axis of the both meshing parts is canceled. Then, the second meshing parts of the female screw member are retreated by the urging force of the spring part of the female screw member and the meshing of the both meshing parts recovers at an adjacent meshing position around the axis. Therefore, the stick-shaped cosmetic material feeding container has a so-called clutch function which can prevent damaging of parts.

SUMMARY OF THE INVENTION

Problems to be Solved by the Invention

In the stick-shaped cosmetic material feeding container described in Japanese Patent Application Laid-Open No. 2008-178604, when the movable body reaches the advancing limit or the retreating limit and relative rotation force for further movement is given to the movable body, the spring part of the female screw member is contracted and the second meshing parts of the female screw member advances against urging force of the spring part of the female screw member, so that the meshing around the axis of the both meshing parts is canceled. However, when the spring part is contracted, twisting force due to the relative rotation effects on the spring part so as to twist the spring part, and the twisting force is transmitted from the spring part to the female thread at the front side so as to effect on the movable body screwed with the female thread. Thus, the twisting force effects also on the stick-shaped cosmetic material supported by the top end of the movable body. As a result, the stick-shaped cosmetic material may be damaged.

Further, in the female screw member, the second meshing parts thereof mesh around the axis with the first meshing parts of the container rear part. However, parts other than the second meshing parts are rotatable around the axis with respect to the container rear part. Thus, the relative rotation force given to the container front part and the container rear part for advancing/retreating the stick-shaped cosmetic material is transmitted, while twisting the spring part. Therefore, there is a problem that the rotation torque to advance/retreat the stick-shaped cosmetic material cannot be transmitted smoothly (a time lag is caused).

Furthermore, since the twisting force effects on the spring part as mentioned above, there is a problem that the spring part is damaged quickly.

The present invention is to solve the aforementioned problems, and an objective of the present invention is to provide a stick-shaped cosmetic material feeding container, in which a clutch function can be exercised to prevent damaging of parts, a stick-shaped cosmetic material is protected without twisting force being effected on the stick-shaped cosmetic material, even when a movable body reaches an advancing limit or a retreating limit, relative rotation force for further moving the movable body is given to the movable body, and an excessive rotation torque effects on the movable body. Further, it is also aimed that a rotation torque due to the relative rotation for advancing/retreating the stick-shaped cosmetic material can be smoothly transmitted, and the life of a spring part can be made long.

Means for Solving the Problem

According to an aspect of the present invention, a stick-shaped cosmetic material feeding container includes a cylindrical container having a container front part and a container rear part; a movable body which is not rotatable around an axis and is movable in an axial direction with respect to the container front part, supports a stick-shaped cosmetic material at a top end thereof, and has a male thread at an outer peripheral part; and a female screw member which is rotatable around the axis with respect to the container front part, and has a female thread to be screwed with the male thread at an inner peripheral part. When the container front part and the container rear part are relatively rotated, a screw part configured with the male thread and the female thread works to advance/retreat the movable body, so that the stick-shaped cosmetic material protrudes from and retracts into an opening of a container top end. The female screw member includes first meshing parts at a rear end part thereof, and the container rear part includes concave groove parts extending in the axial direction on an inner peripheral surface thereof. A clutch spring member is disposed on the rear side of the female screw member. The clutch spring member includes second meshing parts, a spring part, and convex parts. The second meshing parts are provided at a top end part of the clutch spring member and mesh around the axis with the first meshing parts. The spring part is provided at the rear side beyond the second meshing parts and urges the second meshing parts frontward, so that the second meshing parts can mesh around the axis with the first meshing parts at a time of the relative rotation. The spring part is extendable and contractible in the axial direction. The convex parts are provided on an outer peripheral surface at the front side beyond the spring part, enter into the concave groove parts, and are movable in the axial direction and not rotatable around the axis with respect to the container rear part. A rear side part of the clutch spring member beyond the spring part is not movable in the axial direction with respect to the container rear part. When an excessive rotation torque effects on the movable body, the spring part is contracted so as to cancel the meshing around the axis of the both meshing parts.

According to the stick-shaped cosmetic material feeding container configured as mentioned above, the female thread to be screwed with the male thread of the movable body, which supports the stick-shaped cosmetic material and is not rotatable around the axis and is movable in the axial direction with respect to the container front part, is provided at the female screw member, which is rotatable around the axis with respect to the container front part. The spring part extendable and contractible in the axial direction is provided at the clutch spring member, which is located at the rear side of the female screw member and is not rotatable around the axis with respect to the container rear part. By the urging force of the spring part, the second meshing parts at the top end part of the clutch spring member mesh around the axis with the first meshing parts at the rear end part of the female screw member. Accordingly, the female thread and the spring part are provided separately at each part. Thus, even when the movable body reaches the advancing limit or the retreating limit, the relative rotation force for further moving the movable body is given to the movable body, and an excessive rotation torque effects on the movable body, the clutch function for canceling the meshing of the both meshing parts around the axis is exercised by contracting of the spring part, the stick-shaped cosmetic material is protected without the female screw member being twisted and without twisting force being effected on the stick-shaped cosmetic material. Thus, the stick-shaped cosmetic material feeding container can be prevented from damaging of the parts. Further, when the convex parts provided on the outer peripheral surface at the front side beyond the spring part enters into the concave groove parts of the container rear part, the clutch spring member comes to be not rotatable with respect to the container rear part. Thus, when the movable body advances/retreats by relative rotation of the container front part and the container rear part, the rotation torque is transmitted not via the spring part but via the convex parts provided at the front side from the spring part, so that the rotation torque can be transmitted smoothly without twisting the spring part and without causing a time lag. Furthermore, since the rotation torque is transmitted not via the spring part but via the convex parts at the front side beyond the spring part, the spring part is not twisted, so that the life of the spring part can be made long.

In the present invention, the second meshing parts of the clutch spring member are formed by arranging a plurality of chevron shapes in the peripheral direction, where each of the chevron shapes is symmetrical as viewed from the upper side, and projects frontward. Thus, when the movable body reaches any position of the advancing limit and the retreating limit, the clutch function can be exercised.

Effect of the Invention

As mentioned above, the present invention can provide a stick-shaped cosmetic material feeding container, in which a clutch function can be exercised to prevent damaging of parts, a stick-shaped cosmetic material is protected without twisting force being effected on the stick-shaped cosmetic material, even when a movable body reaches an advancing limit or a retreating limit, the relative rotation force for further moving the movable body is given to the movable body, and an excessive rotation torque is effected on the movable body. Further, a rotation torque due to the relative rotation for advancing/retreating the stick-shaped cosmetic material can be smoothly transmitted, and the life of the spring part can be made long.

DETAILED DESCRIPTION OF PREFERRED EMBODIMENT

A preferred exemplary embodiment of a stick-shaped cosmetic material feeding container according to the present invention will be described below with reference to FIGS. 1 to 8. In addition, in each figure, the same numerous codes are used for the same elements, and duplicate descriptions will be omitted.

Figure 1:
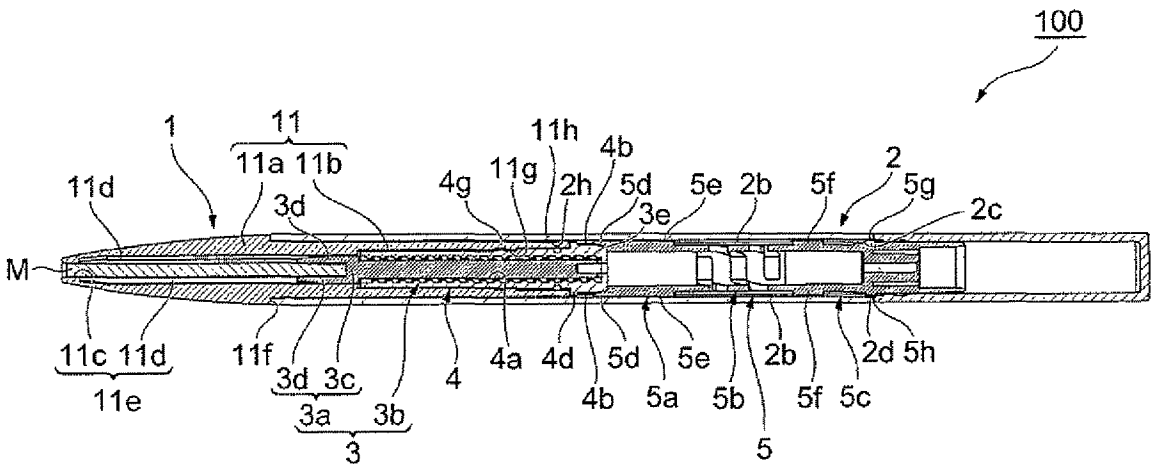
FIG. 1 is a longitudinal sectional view illustrating an initial state of a stick-shaped cosmetic material feeding container according to an exemplary embodiment of the present invention.
Figure 2:
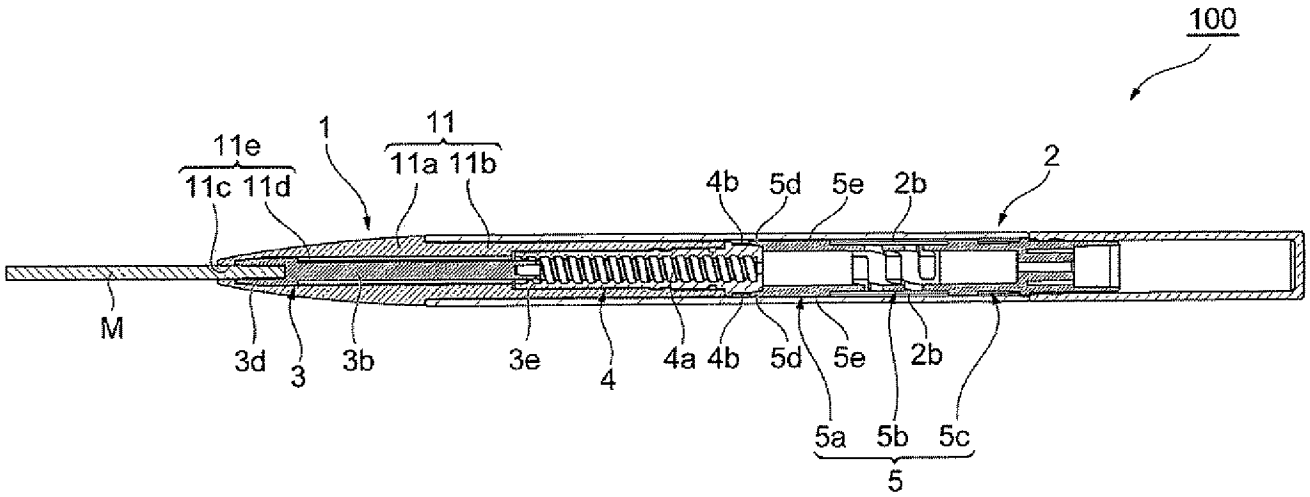
FIG. 2 is a longitudinal sectional view when a stick-shaped cosmetic material support body reaches an advancing limit from the state illustrated in FIG. 1 by a user's operation.
Figure 3:
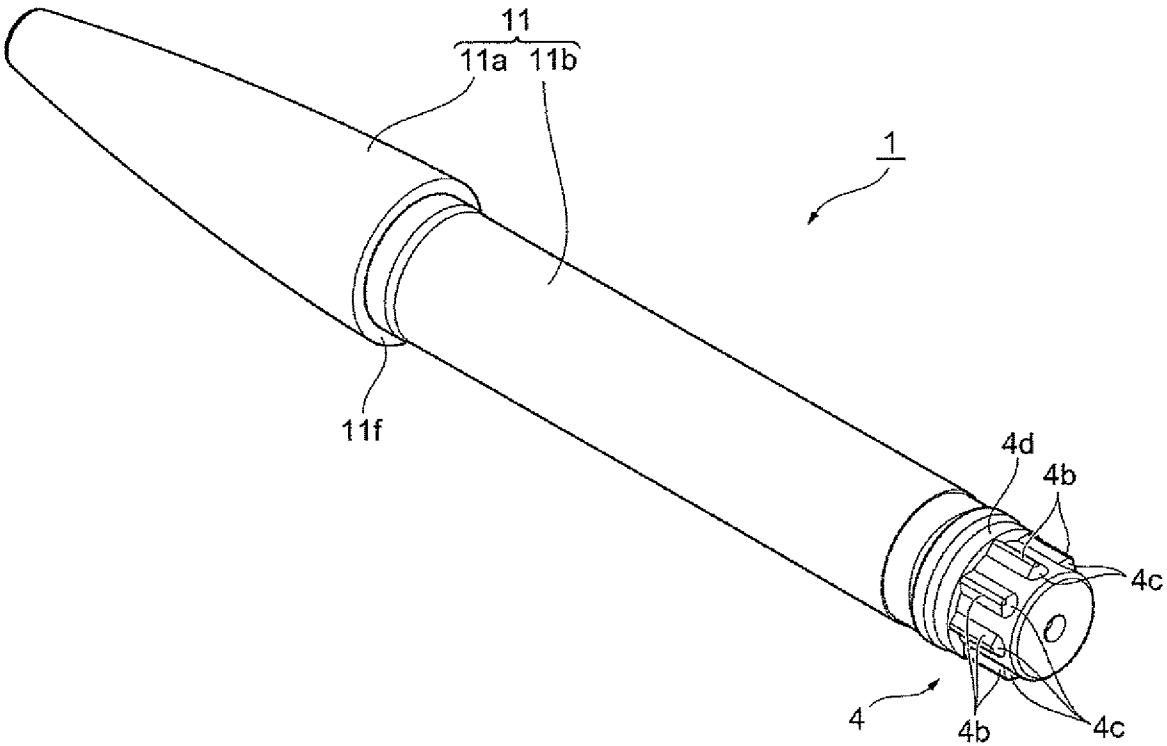
FIG. 3 is a perspective view illustrating a stick-shaped cosmetic material cartridge in FIGS. 1 and 2.
Figure 4:
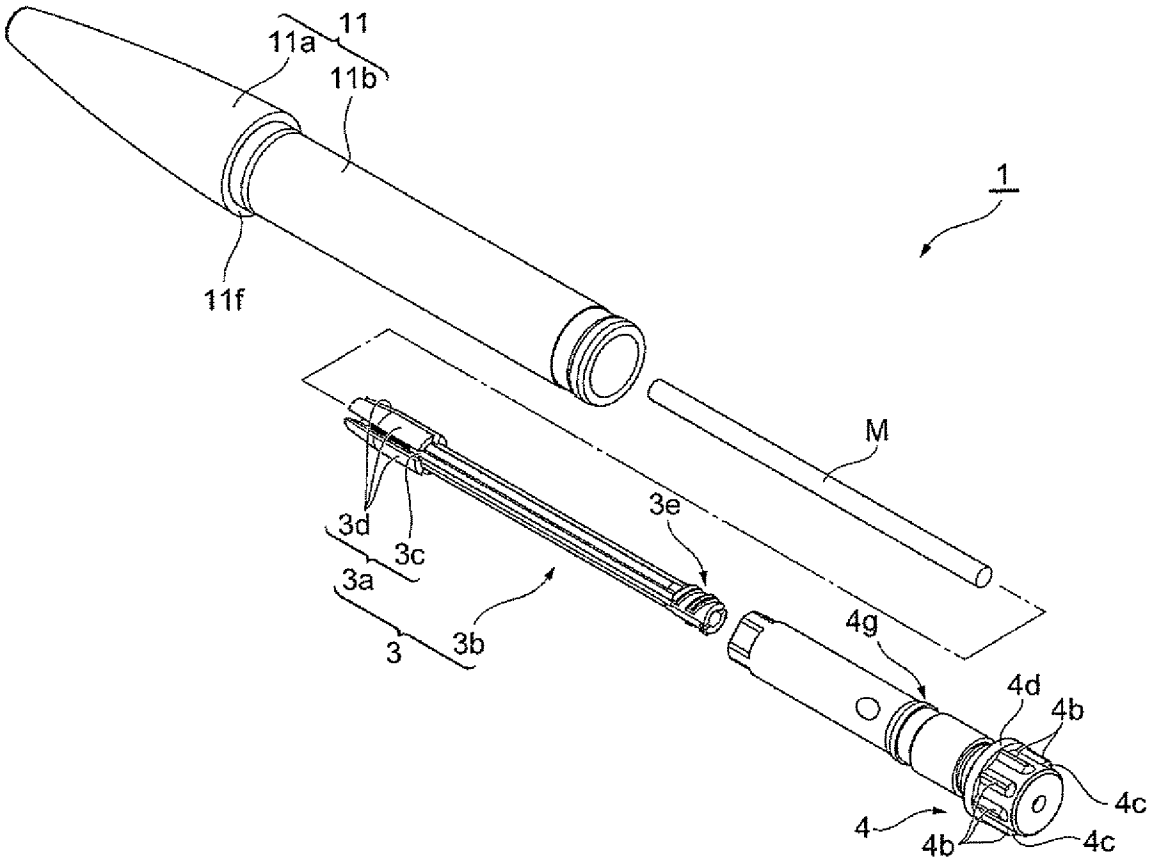
FIG. 4 is an exploded perspective view of the stick-shaped cosmetic material cartridge illustrated in FIG. 3.
Figure 5:
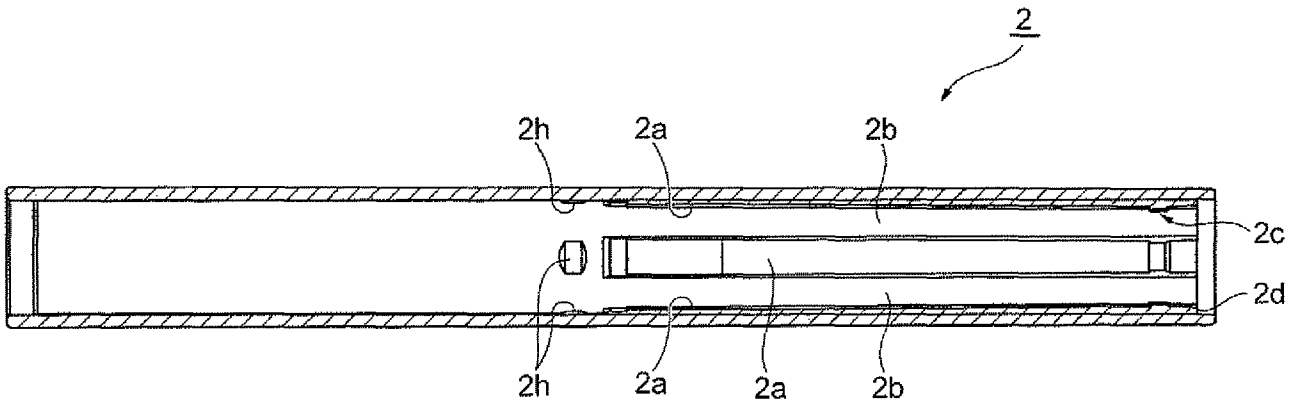
FIG. 5 is a longitudinal sectional view illustrating a main body cylinder in FIGS. 1 and 2.
Figure 6:
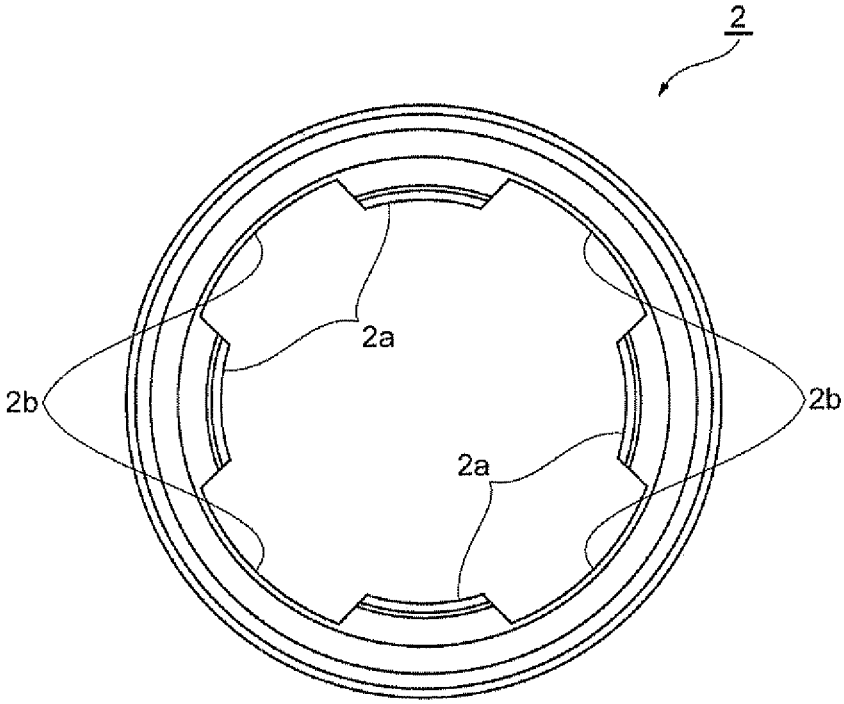
FIG. 6 is a rear view illustrating the main body cylinder in FIGS. 1 and 2.
Figure 7:
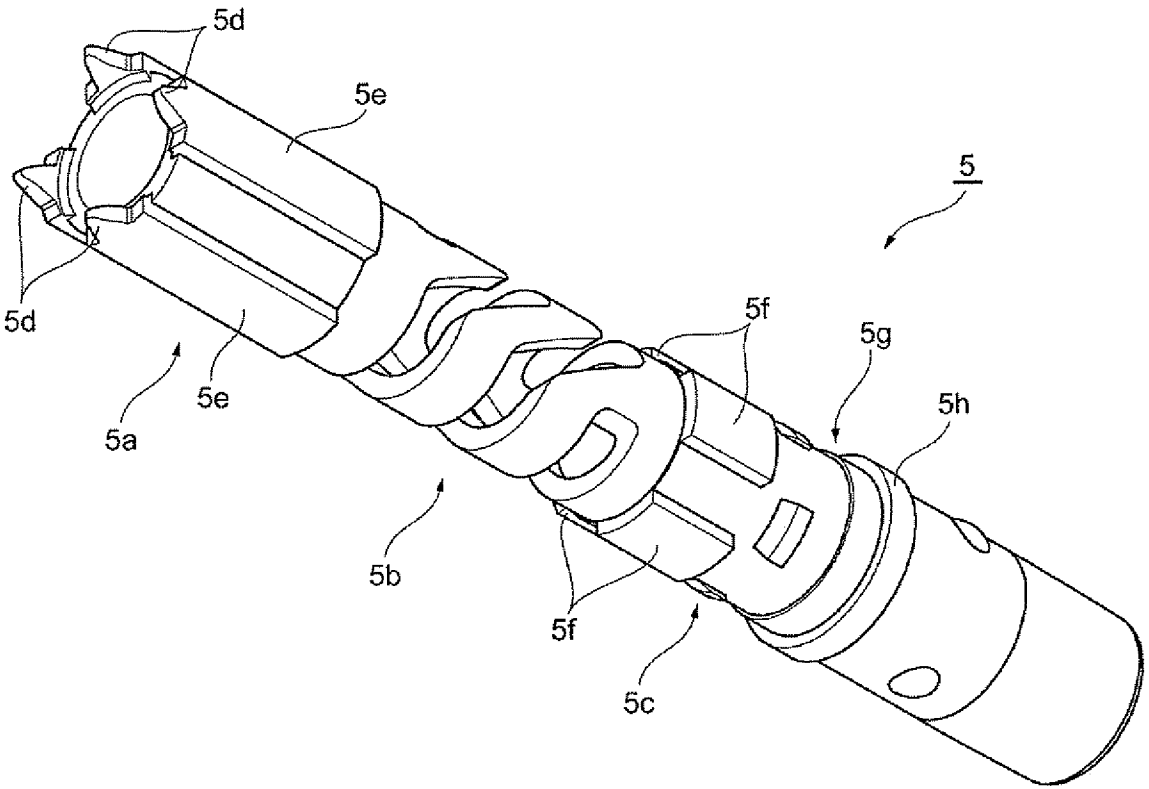
FIG. 7 is a perspective view illustrating a clutch spring member in FIGS. 1 and 2.
Figure 8:
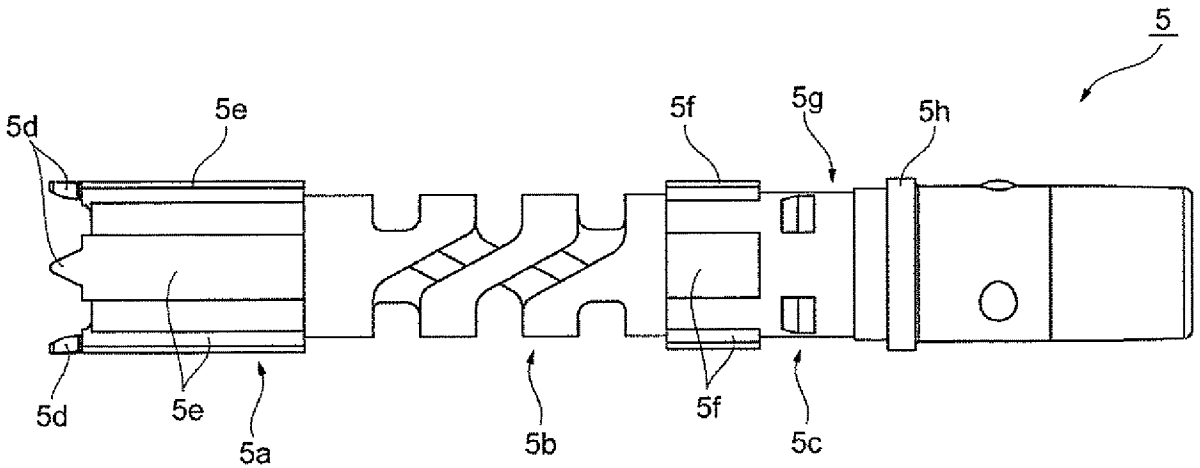
FIG. 8 is a side view illustrating the clutch spring member in FIGS. 1 and 2.

FIG. 1 is a longitudinal sectional view illustrating an initial state of a stick-shaped cosmetic material feeding container according to an exemplary embodiment of the present invention. FIG. 2 is a longitudinal sectional view when a stick-shaped cosmetic material support body reaches an advancing limit from the state illustrated in FIG. 1 by a user's operation. FIGS. 3 and 4 illustrate a stick-shaped cosmetic material cartridge. FIGS. 5 and 6 illustrate a main body cylinder. FIGS. 7 and 8 illustrate a clutch spring member. The stick-shaped cosmetic material feeding container of the present exemplary embodiment houses various kinds of stick-shaped cosmetic materials, e.g., an eyeliner, an eyebrow, a lip liner, a concealer and the like, and a user can optionally protrude/retract the cosmetic materials according to necessity.

As illustrated in FIG. 1, a stick-shaped cosmetic material feeding container 100 is structured such that a whole shape is formed in a slender round rod shape (a stick shape) like a writing instrument so as to have a good outer appearance. The stick-shaped cosmetic material feeding container 100 includes, as an external configuration, a stick-shaped cosmetic material cartridge 1 (refer to FIG. 3) configuring a container front part, and a main body cylinder 2 configuring a container rear part. The stick-shaped cosmetic material feeding container 100 houses, in the stick-shaped cosmetic material cartridge 1 and the main body cylinder 2, a stick-shaped cosmetic material M, a stick-shaped cosmetic material support body 3 which is a movable body for supporting the stick-shaped cosmetic material M, a female screw member 4 configuring one part of a clutch mechanism and a screw part (a screwing mechanism), and a clutch spring member 5 configuring another part of the clutch mechanism.

As illustrated in FIGS. 5 and 6, the main body cylinder 2 has a cylindrical shape. On an inner peripheral surface of a rear half part of the main body cylinder 2, four projected ribs 2*a* extending in an axial direction are formed at four uniformly arranged positions in the peripheral direction. By forming these projected ribs 2*a*, concave groove parts 2*b* extending in the axial direction are formed between the projected ribs 2*a* and 2*a*. The concave groove parts 2*b* are for engaging the clutch spring member 5 in a rotational direction. Further, as illustrated in FIG. 5, the main body cylinder 2 includes engagement parts 2*c* on an inner peripheral surface of a rear end part thereof, for engaging the rear end part of the clutch spring member in the axial direction. Further, the main body cylinder 2 includes projections 2*h* at a position slightly front side from the projected ribs 2*a* on the inner peripheral surface of the rear end part thereof for engaging the stick-shaped cosmetic material cartridge 1 in the axial direction.

As illustrated in FIGS. 1, 3 and 4, the stick-shaped cosmetic material cartridge 1 includes a tip cylinder 11 in a stepped cylindrical shape for housing the stick-shaped cosmetic material M, the stick-shaped cosmetic material support body 3 being arranged in the tip cylinder 11, extending in the axial direction, and supporting the stick-shaped cosmetic material M, and the female screw member 4 to be screwed with the stick-shaped cosmetic material support body 3.

The tip cylinder 11 includes a large diameter part 11*a* which projects from the main body cylinder 2 and can be gripped with fingers, and a small diameter part 11*b* continuously provided at a rear end of the large diameter part 11*a* and housed in the main body cylinder 2. As illustrated in FIG. 1, a front half of a cylinder hole of the tip cylinder 11 is a stick-shaped cosmetic material hole 11*c* for housing the stick-shaped cosmetic material M and causing the stick-shaped cosmetic material to be slidable, and a rear half of the cylinder hole is a hole having a large diameter via a stepped part and housing the female screw member 4.

In the tip cylinder 11, support piece grooves 11*d* are continuously provided at two or more positions (four uniformly arranged positions in the present exemplary embodiment) on a peripheral surface of the stick-shaped cosmetic material hole 11*c* from a position around a top end of the stick-shaped cosmetic material hole 11*c* to a rear end of the stick-shaped cosmetic material hole 11*c*. These support piece grooves 11*d* can house support pieces 3*d* (refer to FIG. 4) of the stick-shaped cosmetic material support body 3, which will be described below, and cause the cosmetic material support body 3 to be slidable. With the stick-shaped cosmetic material hole 11*c* and the support piece grooves 11*d*, an advancing/retreating hole 11*e* in which the stick-shaped cosmetic material M and the support pieces 3*d* slide is configured.

Further, at the approximate middle in the axial direction of the hole for housing the female screw member 4 of the tip cylinder 11, an engagement part 11*g* for engaging the female screw member 4 in the axial direction is formed. On an outer peripheral surface of a rear end part of the small diameter part 11*b*, an annular concave part 11*h* to engage in the axial direction with the projections 2*h* of the main body cylinder 2 is formed.

The female screw member 4 has a cylindrical shape, and includes a female thread 4*a* along the axial direction on the inner peripheral surface of the cylinder hole. The female screw member 4 has an engagement part 4*g* formed on the outer peripheral surface at the approximate middle in the axial direction thereof. The engagement part 4*g* engages in the axial direction with the engagement part 11*g* of the tip cylinder 11.

Further, as illustrated in FIGS. 1, 3 and 4, at a rear end part of the female screw member 4, ribs 4*b* extending along the axial direction are formed at eight uniformly arranged positions in the peripheral direction on the outer peripheral surface of the female screw member 4. Each of the ribs 4*b* has a symmetrical chevron shape as viewed in the axial direction, and includes, on a rear end surface thereof, an inclination surface 4*c* inclined with a downward gradient of 45° from an upper end surface toward a lower end surface. Further, these ribs 4*b* configure first meshing parts and configure one part of the clutch mechanism.

As illustrated in FIGS. 1 and 4, the female screw member 4 is inserted from the rear side of the cylinder hole of the tip cylinder 11, and an annular flange part 4*d* thereof abuts against the rear end surface of the tip cylinder 11, so that the engagement part 4*g* engages in the axial direction with the engagement part 11*g* of the tip cylinder 11. Accordingly, as illustrated in FIG. 3, the female screw member 4 is attached to the tip cylinder 11 so as to be rotatable around the axis and not movable in the axial direction.

As illustrated in FIGS. 1 and 4, the stick-shaped cosmetic material supporting part 3 includes a support part 3*a* for supporting the rear end part of the stick-shaped cosmetic material M, and a shaft body part 3*b* at the rear side beyond the support part 3*a*. The shaft body part 3*b* is a shaft body extending in the axial direction, and includes a screw projection 3*e* on the outer peripheral surface of the rear end part of the shaft body part 3*b*, where the screw projection 3*e* functions as a male thread. The support part 3*a* includes a base part 3*c* for causing the rear end surface of the stick-shaped cosmetic material M to abut, and a plurality of support pieces 3*d* for supporting the rear end surface of the stick-shaped cosmetic material M which is caused to abut against the base part 3*c*. The support pieces 3*d* are provided at two or more positions (four uniformly arranged positions in the present exemplary embodiment) in the peripheral direction on the outer peripheral surface of the base part 3*c*, so as to project toward the top end side. The rear end part of the stick-shaped cosmetic material M is fitted among these support pieces 3*d*, 3*d*.

As illustrated in FIG. 1, the stick-shaped cosmetic material support body 3 having the support part 3*a* and the shaft body part 3*b* is assembled with the tip cylinder 11 and the female screwed member 4 in a following manner. The base part 3*c* of the stick-shaped cosmetic material support body 3 enters into the stick-shaped cosmetic material hole 11*c* of the tip cylinder 11, and the support pieces 3*d* of the stick-shaped cosmetic material support body 3 enter into the support piece grooves 11*d* of the tip cylinder 11, so that the stick-shaped cosmetic support body 3 is inserted into the advancing/retreating hole 11*e*. With this configuration, the support piece grooves 11*d* function as a rotation stopper and engage the stick-shaped cosmetic material support body 3 to be not rotatable around the axis and be movable in the axial direction. The shaft body part 3*b* is inserted into the female screw member 4, and the screw projection 3*e* at the rear end part of the shaft body part 3*b* is screwed with the female thread 4*a* on the inner peripheral surface of the female screw member 4.

Further, the top end surfaces of the support piece grooves 11*d* are caused to be an advancing limit for the stick-shaped cosmetic material support body 3, where the top end surfaces of the support pieces 3*d* of the stick-shaped cosmetic material support body 3 abut against the top end surfaces of the support piece grooves 11. The top end surface of the female screw member 4 is caused to be a retreating limit for the stick-shaped cosmetic material support body 3, where the rear end surface of the base part 3*c* (the support part 3*a*) of the stick-shaped cosmetic material support body 3 abuts against the top end surface of the female screw member 4. In addition, the retreating limit of the stick-shaped cosmetic material support member 3 can be made by causing the rear end surface of the shaft part 3*b* of the stick-shaped cosmetic material support body 3 to abut against the rear end surface (the bottom surface of the inner side) of the inner side of the female screw member 4.

The stick-shaped cosmetic material cartridge 1 having the tip cylinder 11, the stick-shaped cosmetic material M, the stick-shaped cosmetic material support body 3, and the female screw member 4 is inserted from the front side of the cylinder hole of the main body cylinder 2. A stepped surface 11*f* between the large diameter part 11*a* and the small diameter part 11*b* of the tip cylinder 11 abuts against the top end surface of the main body cylinder 2, and the annular concave part 11*h* of the tip cylinder 11 engages with the projections 2*h* of the main body cylinder 2 in the axial direction. With this configuration, stick-shaped cosmetic material cartridge 1 is attached so as to be detachable and rotatable around the axis with respect to the main body cylinder 2.

As illustrated in FIGS. 1, 7 and 8, the clutch spring member 5 is an integrated product made of a resin and configured in an approximately cylindrical shape. The clutch spring member 5 includes a clutch cylinder part 5*a* at a top end part thereof, an attaching part 5*c* on the rear end side thereof, and a spring part 5*b* which connects the clutch cylinder part 5*a* and the attaching part 5*c* and is extendible/contractible in the axial direction.

The clutch cylinder part 5*a* has projection parts 5*d* at four uniformly arranged positions in the peripheral direction on the outer peripheral surface of the top end thereof, and the projection parts 5*d* projects frontward from the top end. The projection part 5*d* has a chevron shape, which is symmetrical as viewed from the upper side, and projects frontward. These projection parts 5*d* are second meshing parts to mesh around the axis with the ribs 4*b* which are the first meshing parts of the main body cylinder 2.

Further, the clutch cylinder part 5*a* has convex parts (projection streaks) 5*e* on the outer peripheral surface thereof, and the convex part 5*e* is formed by extending the rear end of the projection part 5*d* to the rearward spring part 5*b*. These projection parts 5*d* and convex part 5*e* being provided continuously with the projection parts 5*d* and extending rearward are for entering into the concave groove parts 2*b* of the main body cylinder 2 so as to engage in the rotational direction.

The spring part 5*b* includes an approximately spiral slit. With this slit, the spring part 5*b* functions as a compression spring for frontward urging the projection parts 5*d* which are the second meshing parts of the clutch cylinder part 5*a*, and these spring part 5*b* and the projection parts (second meshing parts) 5*d* configure another part of the clutch mechanism.

The attaching part 5*c* is a cylindrical part continuously provided at a rear end of the spring part 5*b*. The attaching part 5*c* has convex parts (projection streaks) 5*f* at positions apart rearward from those of the projection parts 5*d* of the clutch cylinder part 5*a* on the outer peripheral surface of the attaching part 5*c*, and the convex parts 5*f* enter into the concave grooves 2*b* of the main body cylinder 2 so as to engage in the rotational direction. Further, the attaching part 5*c* has an engagement part 5*g* formed at a rear part thereof, and the engagement part 5*g* engages in the axial direction with the engagement parts 2*c* of the main body cylinder 2.

As illustrated in FIG. 1, the clutch spring member 5 having the clutch cylinder part 5*a*, the spring part 5*b*, and the attaching part 5*c* is inserted from the rear end side of cylinder hole of the main body cylinder 2 so that the projection parts 5*d* of the clutch spring member 5 agree with the concave groove parts 2*b* of the main body cylinder 2. An annular flange part 5*h* at the rear part of the attaching part 5*c* enters into and abuts against the annular concave part 2*d* (refer to FIG. 5) formed on the rear end surface of the main body cylinder 2, and the projection parts 5*d* and the convex parts 5*e* and 5*f* enter into the concave groove parts 2*b* of the main body cylinder 2 so as to engage in the rotational direction. Further, the engagement part 5*g* of the attaching part 5*c* engages with the engagement parts 2*c* of the main body cylinder 2 in the axial direction. With this configuration, the attaching part 5*c* is caused to be not rotatable and not movable in the axial direction with respect to the main body cylinder 2. Further, the clutch cylinder part 5*a* and the spring part 5*b* are caused to be not rotatable and be movable in the axial direction with respect to the main body cylinder 2.

Further, in the aforementioned state, the projection parts 5*d* of the clutch spring member 5 are urged frontward by the spring part 5*b* and each of them enters between the ribs 4*b*, 4*b* of the female screw member 4, so that meshing around the axis can be made at a time of relative rotation of the tip cylinder 11 and the main body cylinder 2.

In the stick-shaped cosmetic material feeding container 100 of the present exemplary embodiment configured as mentioned above, when a user relatively rotates the tip cylinder 11 and the main body cylinder 2 in the feeding direction which is one direction, the ribs 4*b* of the female screw member 4 and the projection parts 5*d* of the clutch spring member 5 mesh around the axis, so that the female screw member 4 comes to be connected non-rotatably (synchronous-rotatably) around the axis to the main body cylinder 2 via the clutch spring member 5. Then, as illustrated in FIG. 2, the screw part configured with the screw projection 3*e* of the stick-shaped cosmetic material support body 3 and the female thread 4*a* of the female screw member 4 works the stick-shaped cosmetic material support body 3 to advance, so that the stick-shaped cosmetic material M appears from the opening of the top end of the tip cylinder 11 to become ready for use. The stick-shaped cosmetic material support body 3 is caused to be not rotatable around the axis and be movable in the axial direction with respect to the tip cylinder 11. The female screw member 4 is caused to be rotatable around the axis with respect to the tip cylinder 11 and connected to the main body cylinder 2 to be not rotatable by the aforementioned meshing.

Further, when the user relatively rotates the tip cylinder 11 and the main body cylinder 2 in a retracting direction which is an opposite direction to the one direction, the stick-shaped cosmetic material support body 3 retracts, and the stick-shaped cosmetic material M retracts into the opening at the top end of the tip cylinder 11.

In the present exemplary embodiment, as illustrated in FIG. 2, the top end surfaces of the support pieces 3*d* of the stick-shaped cosmetic material support body 3 abut against the top end surfaces of the support piece grooves 11*d*, and the stick-shaped cosmetic material support body 3 reaches the advancing limit. Further, as illustrated in FIG. 1, the rear end surface of the base part 3*c* of the stick-shaped cosmetic material support body 3 abuts against the top end surface of the female screw member 4, and the stick-shaped cosmetic material support body 3 reaches the retreating limit (or the rear end surface of the shaft body part 3*b* of the stick-shaped cosmetic material support body 3 abuts against the rear end surface of the inner side (a bottom surface of the inner side) of the female screw member 4, and the stick-shaped cosmetic material support body 3 reaches the retreating limit). When the relative rotation force for further moving the stick-shaped cosmetic material support body 3 is given at these advancing/retreating limits and an excessive rotation torque is effected on the stick-shaped cosmetic material support body 3, the spring part 5*b* of the clutch spring part 5 is contracted, the clutch cylinder part 5*a* is retreated, and the meshing around the axis of the first meshing parts (the ribs 4*b* of the female screw member 4) and the second meshing parts (the projection parts 5*d* of the clutch spring member 5) is canceled. Then, the clutch cylinder part 5*a* of the clutch spring member 5 is advanced by the urging force of the spring part 5*b*, and the meshing of the both engagement parts 4*b* and 5*d* recovers at a meshing position adjacent in the rotational direction. Thus a so-called clutch function is achieved.

At this time, in the stick-shaped cosmetic material feeding container 100 of the present exemplary embodiment, the female thread 4*a*, which is screwed with the screw projection 3*e* of the stick-shaped cosmetic material support body 3, and the spring part 5*b* are provided in separate parts. Thus, the clutch function can be exercised to prevent damaging of parts, the stick-shaped cosmetic material M is protected without the female screw member 4 being twisted and without twisting force being effected on the stick-shaped cosmetic material M. Incidentally, in the conventional stick-shaped cosmetic material feeding container, the female thread and the spring part are provided on one part. When the spring part is twisted, the twisting force is transmitted from the spring part to the female thread at the front side and effected on the movable body screwed with the female thread, so that the twisting force is effected also on the stick-shaped cosmetic material supported by the top end of the movable body. As a result, the stick-shaped cosmetic material may be damaged.

Further, in the present exemplary embodiment, the projection parts 5*d* and the convex parts 5*e* which are provided on the outer peripheral surface at the front side beyond the spring part 5*b* of the clutch spring member 5 enter into the concave groove parts 2*b* of the main body cylinder 2, so that the clutch spring member 5 is not rotatable with respect to the main body cylinder 2. Thus, in a state that a user relatively rotates the tip cylinder 11 and the main body cylinder 2 in a feeding direction or a retracting direction so as to advance/retreat the stick-shaped cosmetic material M, the rotation torque is transmitted not via the spring part 5*b* but via the projection parts 5*d* and the convex parts 5*e* which are at the front side beyond the spring part 5*b*, so that the rotation torque can be transmitted smoothly without twisting the spring part 5*b* and causing the time lag. Furthermore, since the rotation torque is transmitted not via the spring part 5*b* but via the projection parts 5*d* and the convex parts 5*e*, which are at the front side beyond the spring part 5*b*, and the spring part 5*b* is not twisted, the life of the spring part 5*b* can be made long.

In addition, in the present exemplary embodiment, the projection parts 5*d* are configured to enter into the concave groove parts 2*b* of the main body cylinder 2. However, the following configuration can be also used. The projection parts 5*d* are provided at a more inner side position in the axial direction than that of the present exemplary embodiment so as not to enter into the concave groove parts 2*b* of the main body cylinder 2, and only the convex parts 5*e* enter into the concave groove parts 2*b*. Alternatively, the convex parts 5*e* are not formed, and the projection parts 5*d* are formed to be convex parts entering into the concave groove part 2*b* so as to have an engagement function in the rotational direction with respect to the main body cylinder 2 and to have a function of a meshing part.

Further, in the present exemplary embodiment, the second meshing parts of the clutch spring member 5 are formed by arranging a plurality of chevron shapes in the peripheral direction, where each of the chevron shapes is symmetrical as viewed from the upper side, and projects frontward. Thus, even when the stick-shaped cosmetic material support body 3 reaches any position of the advancing limit and the retreating limit, the clutch function can be exercised.

Furthermore, in the configuration of the present exemplary embodiment, the clutch spring member 5 is configured to be not rotatable around the axis with respect to the main body cylinder 2 by providing the concave groove parts 2*b* at the main body cylinder 2. Thus, the size of the present exemplary embodiment can be made small without increasing the outer diameter of the main body cylinder 2.

In addition, regarding the engagement in the axial direction of the engagement part 4*g* of the female screw member 4 with respect to the engagement part 11*g* of the tip cylinder 11, this engagement can be an engagement positively having a gap (looseness) in the axial direction. By adopting the configuration as mentioned above and enabling the female screw member 4 to slightly move in the axial direction, for example, an impact due to a fall or the like of the stick-shaped cosmetic material feeding container 100 or an impact effected on the stick-shaped cosmetic material M at a time of outer force such as a vibration or the like being effected can be absorbed and reduced by extending/contracting of the spring part 5*b* of the clutch spring member 5 via the stick-shaped cosmetic material support body 3 and the female screw member 4. Thus, the stick-shaped cosmetic material M can be prevented from removing from the support part 3*a* of the stick-shaped cosmetic material support body 3. Further, when the stick-shaped cosmetic material. M is coated to a part to be coated, the spring part 5*b* of the clutch spring member 5 is extended/contracted via the stick-shaped cosmetic material support body 3 and the female screw member 4. Thus, a coating pressure comes to be appropriate so as to improve a feeling at a time of use. In addition, since the coating pressure is appropriate, the breakage of the stick-shaped cosmetic material M can be prevented.

The present invention is described in detail according to the exemplary embodiment. However, the present invention is not limited in the above-described exemplary embodiment. For example, in the exemplary embodiment, the stick-shaped cosmetic material cartridge 1 is detachable with respect to the main body cylinder 2. However, the stick-shaped cosmetic material cartridge 1 can be made non-detachable with respect to the main body cylinder 2, and does not necessarily have the shape of a cartridge.

Further, the male thread and the female thread can be replaced with others which work like threads such as a projection group disposed intermittently and a projection group disposed spirally and intermittently. Furthermore, the screw projection can be a continuous thread.

What is claimed is:

1. A stick-shaped cosmetic material feeding container comprising:

a cylindrical container having a container front part and a container rear part;

a movable body being not rotatable around an axis and being movable in an axial direction with respect to the container front part, supporting a stick-shaped cosmetic material at a top end thereof, and having a male thread at a rear end thereof;

a female screw member having a cylindrical shape and provided to be rotatable around the axis with respect to the container front part, and having provided on an inner peripheral surface thereof a female thread along the axial direction to be screwed with the male thread of the movable body, wherein, by a relative rotation of the container front part and the container rear part, a screw part defined by the male thread and the female thread works to advance/retreat the movable body so that the stick-shaped cosmetic material protrudes from and retracts into an opening provided in a top end of the container front part, wherein the female screw member comprises a plurality of ribs provided on an outer peripheral surface at a rear end part thereof, and arranged separately in the peripheral direction; and a clutch spring member disposed on a rear side of the female screw member, said clutch spring member comprising:

a clutch cylinder part having projection parts arranged in the peripheral direction on the outer peripheral surface at a top end thereof, the projection parts projecting in the axial direction to be engaged with the ribs of the female screw member;

a spring part, which is extendable and contractible in the axial direction, provided continuously with the clutch cylinder part at a rear end thereof, urging the projecting parts toward the female screw member so that the projecting parts can be engaged with the ribs at a time of the relative rotation, wherein said clutch cylinder part is configured to be movable in the axial direction and not rotatable around the axis with respect to the container rear part; and an attaching part having a cylindrical shape provided continuously with the spring part at a rear end thereof, said attaching part being not rotatable and not movable in the axial direction with respect to the container rear part;

wherein, when an excessive rotation torque effects on the movable body, the spring part is contracted so as to disengage the coupling between the ribs and the projecting parts.

2. The stick-shaped cosmetic material feeding container as claimed in claim 1, wherein the projecting parts of the clutch spring member have chevron shapes in the peripheral direction, and each of the chevron shapes is symmetrical as viewed from the upper side.

* * * * *